US009746281B2

(12) United States Patent
Wilson et al.

(10) Patent No.: US 9,746,281 B2
(45) Date of Patent: Aug. 29, 2017

(54) LATCH AND RELEASE MECHANISM FOR ADJUSTABLE FIREARM STOCK

(71) Applicant: Sig Sauer, Inc., Newington, NH (US)

(72) Inventors: John Wilson, East Waterboro, ME (US); Cory J. Newman, Providence, UT (US); David B. Hopkins, Exeter, NH (US)

(73) Assignee: SIG SAUER INC., Newington, NH (US)

( * ) Notice: Subject to any disclaimer, the term of this patent is extended or adjusted under 35 U.S.C. 154(b) by 0 days.

(21) Appl. No.: 15/000,914

(22) Filed: Jan. 19, 2016

(65) Prior Publication Data

US 2016/0209161 A1 Jul. 21, 2016

Related U.S. Application Data

(60) Provisional application No. 62/104,941, filed on Jan. 19, 2015.

(51) Int. Cl.
*F41C 23/00* (2006.01)
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/04; F41C 23/14
See application file for complete search history.

(56) References Cited

U.S. PATENT DOCUMENTS

| | | | | |
|---|---|---|---|---|
| 8,950,099 | B2 * | 2/2015 | Rogers | F41C 23/04 42/71.01 |
| 9,488,435 | B1 * | 11/2016 | Roberts | F41C 23/14 |
| 2006/0254111 | A1 | 11/2006 | Giauque et al. | |
| 2010/0205846 | A1 * | 8/2010 | Fitzpatrick | F41A 11/02 42/73 |
| 2015/0276343 | A1 * | 10/2015 | Zusman | F41C 23/04 42/71.01 |
| 2017/0082394 | A1 * | 3/2017 | Chow | F41C 23/06 |

FOREIGN PATENT DOCUMENTS

| | | | |
|---|---|---|---|
| CH | EP 2080980 A2 * | 7/2009 | F41C 23/04 |

* cited by examiner

*Primary Examiner* — Gabriel Klein
(74) *Attorney, Agent, or Firm* — Finch & Maloney PLLC

(57) ABSTRACT

An adjustable stock assembly includes a housing, a stock rail, a release, a key movable with respect to the release, a latch rotatable about a latch pivot between a latched position, an unlatched position and a disassembly position, and a latch cam pin coupled to the release. The housing is extendable and retractable with respect to the stock rail. The stock rail has a slot and one or more recesses adjacent to the slot that can engage the latch, thereby preventing disassembly of the rail from the housing and further securing the rail in a particular configuration. When partially depressed along with the key, the release disengages the latch from the stock rail recesses, allowing the housing to extend and retract within its adjustment range. The housing can be disassembled from the stock rail when the key and release are fully depressed.

20 Claims, 8 Drawing Sheets

LATCH AND RELEASE MECHANISM FOR ADJUSTABLE FIREARM STOCK

CROSS REFERENCE TO RELATED APPLICATIONS

This application claims the benefit of U.S. Provisional Patent Application Ser. No. 62/104,941, filed Jan. 19, 2015, which is hereby incorporated by reference in its entirety.

FIELD OF THE DISCLOSURE

This disclosure relates generally to firearm stocks, and more particularly, to an adjustable firearm stock having a latch and release mechanism.

BACKGROUND

A stock is a part of a rifle or other firearm that a shooter holds against the shoulder when firing the weapon. A receiver and barrel assembly can be attached to the stock. An adjustable stock allows the receiver and barrel to be extended from or retracted into the stock housing in a telescoping manner. A locking mechanism located within the stock housing secures the firearm at the desired length. In general, some existing adjustable stock designs suffer compromises between ease of use, adjustment security, and compactness.

SUMMARY

According to an example embodiment, an adjustable stock assembly for a firearm includes a firearm stock rail having a slot and a plurality of recesses adjacent to the slot, a firearm stock housing being extendable and retractable with respect to a stock rail and an attached receiver (i.e. a rifle); a latch being rotatable between a latched position, an unlatched position and a disassembly position, the latch having an engagement member configured to engage one of the recesses of the stock rail while the latch is in the latched position and to engage the slot while the latch is in the unlatched position; a release operatively coupled to the latch; and a key movable with respect to the release, the key being configured and arranged to limit rotational movement of the latch. In some cases, the key has a profiled upper surface having a plurality of cuts, the key limiting rotation of the latch when the latch contacts one of the cuts. In some such cases, the key is configured to be manually depressed, whereby manual depression of the key positions one of the cuts adjacent to the latch, thereby permitting rotation of the latch. In some cases, the release is movable parallel to a longitudinal axis of the adjustable stock assembly, and the adjustable stock assembly includes a cam slot formed in the latch, the cam slot being non-parallel to the longitudinal axis. In some such cases, the adjustable stock assembly includes a latch cam pin coupled to the release and disposed within the cam slot of the latch. In some such cases, the latch cam pin is configured to move within the cam slot in response to movement of the release, wherein manual depression of the key allows the release to move and causing the latch cam pin to move within the cam slot, in turn causing the latch to rotate away from the stock rail, thereby disengaging the engagement member from the recess. In some cases, the adjustable stock assembly includes a latch spring configured to urge the latch toward the latched position and urge the key to an extended position and wherein the key and release are pressed, force is transferred through the latch spring to urge the latch to the unlatched position. In some cases, the adjustable stock assembly includes a connector coupled to the stock rail for attaching a receiver to the adjustable stock assembly. In some cases, the latch is configured as an over-center toggle lock.

According to another example embodiment, an adjustable stock assembly includes a housing; a stock rail having a slot and a plurality of recesses adjacent to the slot wherein the housing can be extendable and retractable with respect to the stock rail; a release movable parallel to a longitudinal axis of the adjustable stock assembly; a latch pivot; a latch being rotatable about the latch pivot between a latched position, an unlatched position and a disassembly position, the latch having: an engagement member configured to engage one of the recesses of the stock rail while the latch is in the latched position and to engage the slot while the latch is in the unlatched position; and a cam slot formed in the latch, the cam slot being non-parallel to the longitudinal axis; a latch spring configured to urge the latch toward the latched position; a latch cam pin coupled to the release and disposed within the cam slot of the latch; and a key movable with respect to the release, the key being configured and arranged to limit rotational movement of the latch. In some cases, the key has a profiled upper surface having a plurality of cuts, the key limiting rotation of the latch when the latch contacts one of the cuts. In some such cases, the profiled upper surface of the key has three cuts, and, in a first configuration, the portion of the latch is in contact with a first cut preventing the latch from rotating towards the unlatched position; in a second configuration, the portion of the latch is in contact with a second cut that is deeper than the first cut permitting the latch to rotate towards the unlatched position, thereby causing the engagement member of the latch to be disengaged from all of the recesses of the stock rail; and in a third configuration, the portion of the latch is in contact with a third cut that is deeper than the second cut permitting the latch to rotate towards the disassembly position, thereby causing the engagement member of the latch to be clear the slot of the stock rail and permitting disassembly of the stock rail from the housing. In some cases, the latch cam pin is configured to move within the cam slot in response to movement of the release, whereby manual depression of the release causes the latch cam pin to move rearward within the cam slot, in turn causing the latch to rotate away from the stock rail, thereby disengaging the engagement member from the recess. In some cases, the key is configured to be manually depressed, whereby manual depression of the key positions one of the cuts adjacent to the latch, thereby permitting rotation of the latch. In some cases, the latch is configured as an over-center toggle lock. In some cases, the adjustable stock assembly includes a foldable hinge coupled to one end of the stock rail.

According to another example embodiment, an adjustable stock assembly includes a housing; a stock rail having a slot and a plurality of recesses adjacent to the slot; a latch pivot; a latch being positioned beneath the stock rail within the housing and rotatable about the latch pivot between a latched position, an unlatched position and a disassembly position, the latch having an engagement member configured to engage one of the recesses of the stock rail while the latch is in the latched position and to engage the slot while the latch is in the unlatched position; a release disposed in the housing and having an opening; and a key disposed within the opening of the release, wherein depressing the key allows the release to move and causing the latch to be displaced from the plurality of recesses in the stock rail causing the housing to be extendable and retractable with respect to the stock rail. In some cases, the adjustable stock assembly includes a cam slot formed in the latch. In some cases, the adjustable stock assembly includes a latch cam pin disposed within the cam slot of the latch. In some cases, the adjustable stock assembly includes a connector coupled to the stock rail for attaching a receiver to the adjustable stock assembly.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

General Overview

Figure 1:
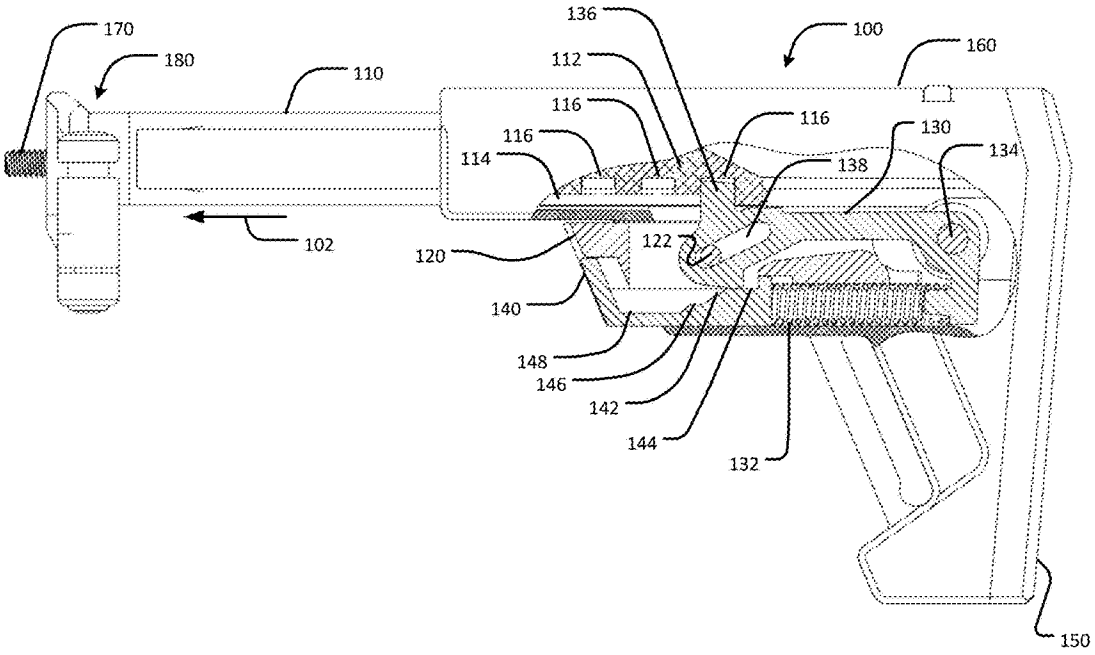
FIG. 1 is a side cutaway view of an example adjustable stock assembly, shown in an extended and latched configuration, in accordance with an embodiment of the present disclosure.

In accordance with a set of embodiments, a novel latch and release mechanism for an adjustable firearm stock assembly is disclosed. In some embodiments, the latch and release mechanism can be activated by the firearm user to place the adjustable firearm stock in one of three different positions: a latched position, an unlatched position, or a disassembled position. In the latched position, the stock rail is stationary and secured with respect to the housing. In the unlatched position, the housing can be extended or retracted to adjust the total length of the firearm stock, but cannot be removed from the stock rail. In the disassembled position, the housing can be removed from or re-inserted onto the stock rail.

According to an embodiment, an adjustable stock assembly includes a housing, a stock rail, a release, a key, and a latch rotatable about a latch pivot between a latched position, an unlatched position and a disassembly position. The latch interfaces with two or more recesses in the stock rail to secure the stock rail in a selected location along a longitudinal axis. The latch can be displaced from the one or more recesses and held in an intermediate position where it is retained by a longitudinal slot in the bottom of the stock rail, allowing the housing to slide forward and backward in relation to the stock rail a distance equal to the length of the slot. The latch can be further displaced so that the engagement member is positioned beneath and free of the slot, and the housing can then be removed from or inserted onto the stock rail.

In this embodiment, the latch is rotatably mounted on a pivot point but the rotation of the latch is limited by one or more surfaces of the key. The latch may be biased either upwardly or downwardly by, for example, a spring. When the user manually depresses the key, such as by sliding it backwards, the key advances in relation to the latch and the latch may move down, but the downward latch motion may be limited by the key cuts of different heights along the length of the key. Depressing the key a predetermined distance may also force the release to start to move. When the release is activated, the movement of the release slides an integral cam pin that is also retained in one or more cam slots within the latch. The cam slot may be angled so that when the cam pin is moved horizontally, the latch is positioned either up or down as the cam pin slides in the cam slot. The combination of the key and release can allow the user to adjust the firearm stock between latched, unlatched and disassembled positions. The key and release may be configured, such as by overlapping, so that they can be activated by a common finger. In other embodiments, the key and release also may be integrated together, so that pushing the key, for example, also activates the release.

In one set of embodiments, the stock rail can be configured to allow the housing to retract and extend in relation to the firearm. The stock rail can have a slot and one or more recesses adjacent to the slot that can engage the latch, thereby preventing disassembly of the stock rail from the housing and further securing the stock rail in a particular configuration (e.g., fully extended, partially retracted, or fully retracted). The release is movable and in some embodiments is movable in a direction parallel to a longitudinal axis of the adjustable stock assembly. In other embodiments the release may be angled in relation to the longitudinal axis of the stock assembly. When the release is partially depressed along with the key, the latch disengages from the stock rail recesses, allowing the housing to extend and retract within its adjustment range. The housing can be disassembled from the stock rail when the key and release are fully depressed. The latch includes an engagement member configured to engage one of the recesses of the stock rail while the latch is in the latched position and to engage the slot, but not any recesses, while the latch is in the unlatched position. In the disassembly position, the engagement member is not engaged with any of the recesses or the slot, thereby permitting disassembly and removal of the stock rail from the housing. A cam slot can be formed in the latch. The cam slot can be non-parallel to the longitudinal axis (e.g., diagonal to the direction of movement of the release). The latch cam pin can be disposed within the cam slot of the latch.

A latch spring is configured to urge the latch toward the latched position by urging the release and key to an extended position, for example, a forward position. The key is configured and arranged to limit rotational movement of the latch and limits the travel of the release. For instance, when the key is not depressed, the latch is locked in engagement with the stock rail, which also prevents depressing the release. When the key is partially depressed, the release can be depressed to rotate the latch toward the unlatched position and out of engagement with the stock rail recesses, but such rotation is limited by the key to prevent the latch from clearing the slot in the stock rail. When the key is fully depressed, the release can be fully depressed to activate the cam mechanism and rotate the latch fully toward or past the unlatched position, allowing the latch to clear the slot for disassembling the housing from the stock rail. Numerous configurations and variations will be apparent in light of this disclosure.

As will be appreciated in light of this disclosure, some embodiments may realize benefits and advantages as compared to existing approaches. For instance, in some embodiments, the disclosed adjustable stock assembly provides a compact structure using a minimal number of parts and ergonomic advantages over existing adjustable stock designs. Further, the disclosed adjustable stock assembly features an intuitive trigger mechanism for unlatching the stock rail, the strength of an over-center latch linkage mechanism, and a stress path that strays less than 5/16 of an inch from the bottom portion of the stock rail stem. Still further, the disclosed adjustable stock assembly may include a connector for easily and quickly attaching a receiver to one end of the adjustable firearm stock. The connector may be a screw, clamp, latch or any other attachment mechanisms.

In some cases, and in accordance with various embodiments, the adjustable stock assembly can be configured, for example, as: (1) a partially or completely assembled stock assembly, and/or (2) a kit or other collection of discrete components as variously described herein that may be used to practice one or more of the disclosed embodiments.

Structure and Operation

Figure 2:
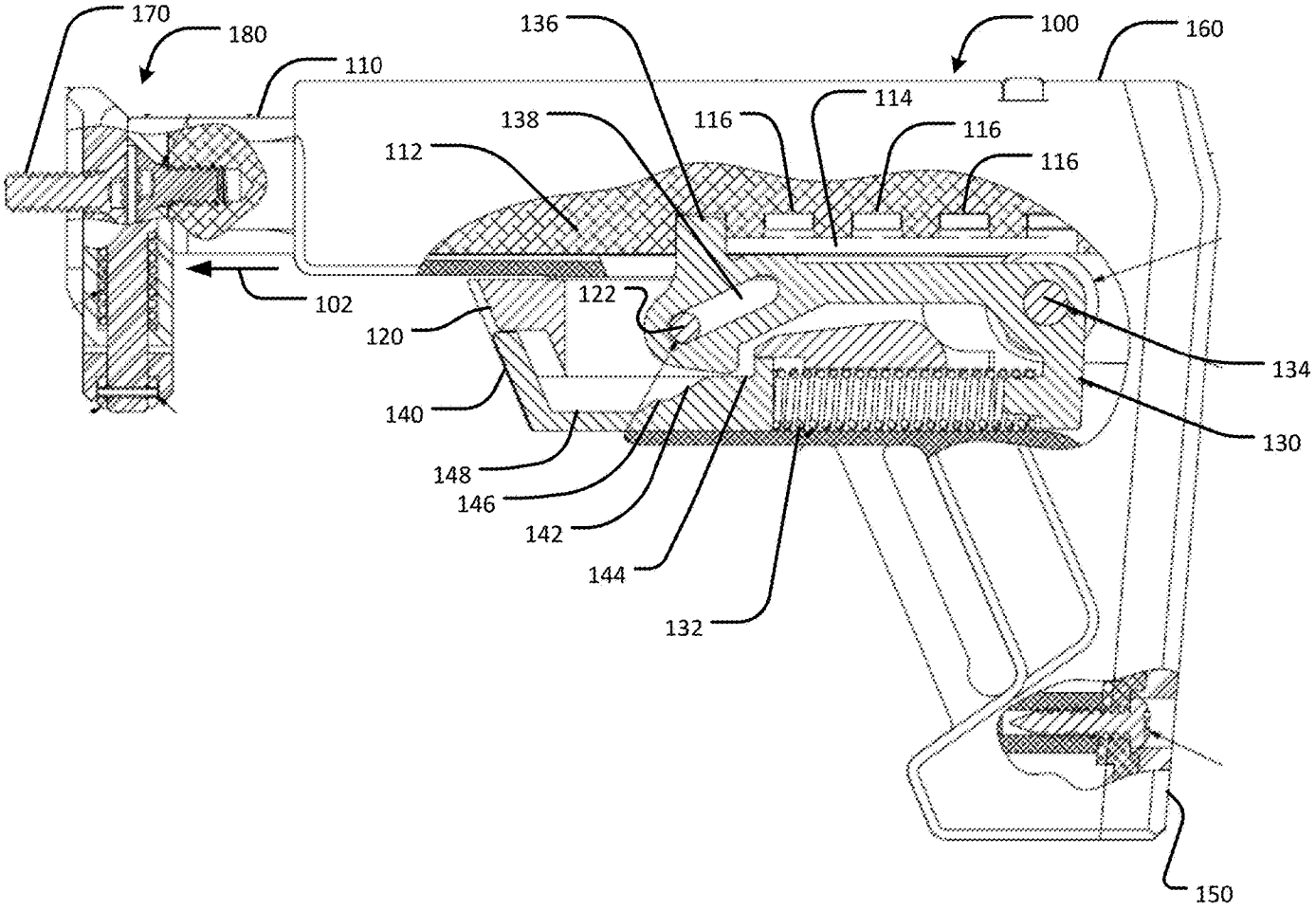
FIG. 2 is another side cutaway view of the example adjustable stock assembly of FIG. 1, shown in a retracted and latched configuration, in accordance with an embodiment of the present disclosure.
Figure 3:
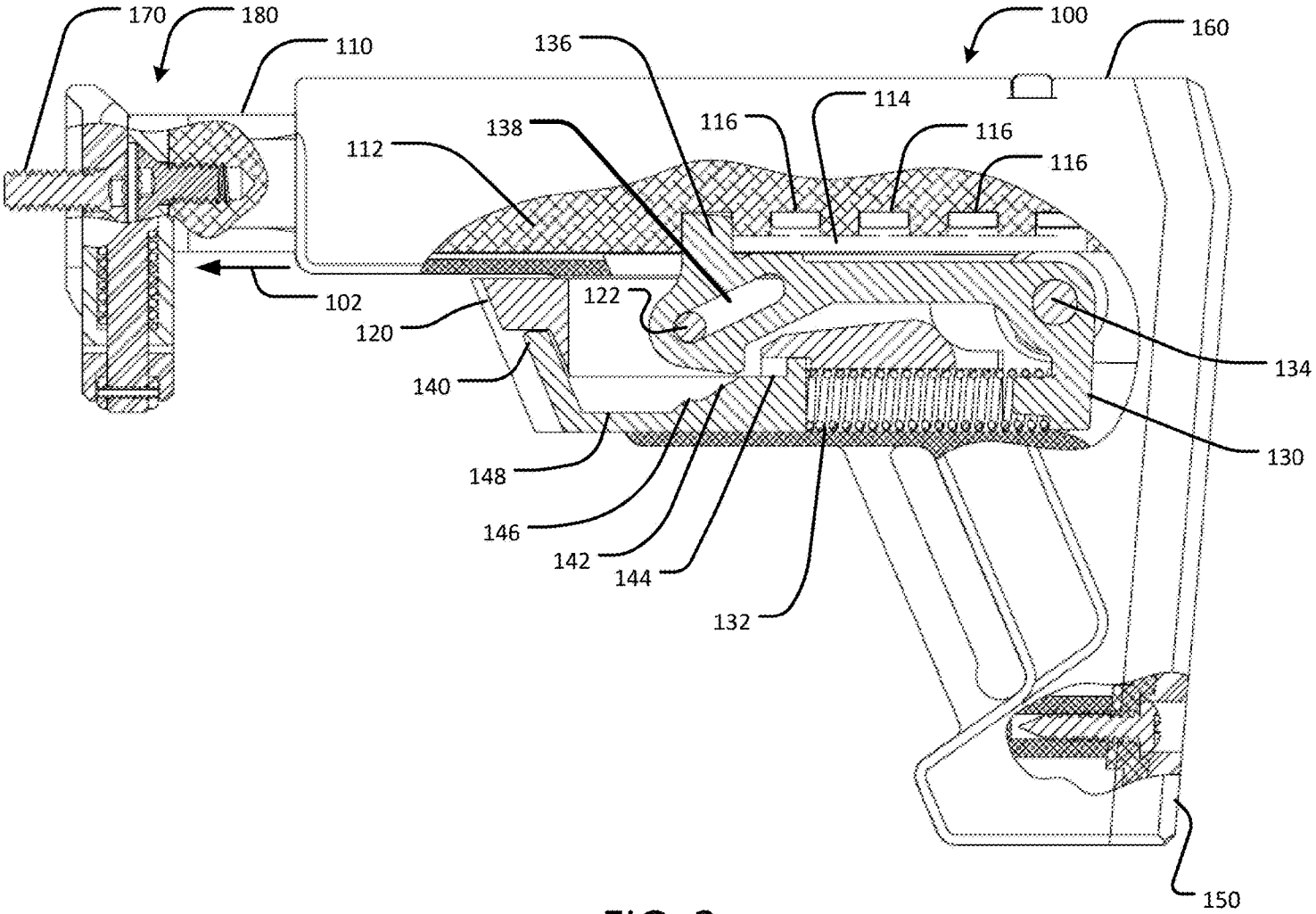
FIG. 3 is another side cutaway view of the example adjustable stock assembly of FIG. 1, shown in the retracted and latched configuration with the key being partially depressed, in accordance with an embodiment of the present disclosure.
Figure 4:
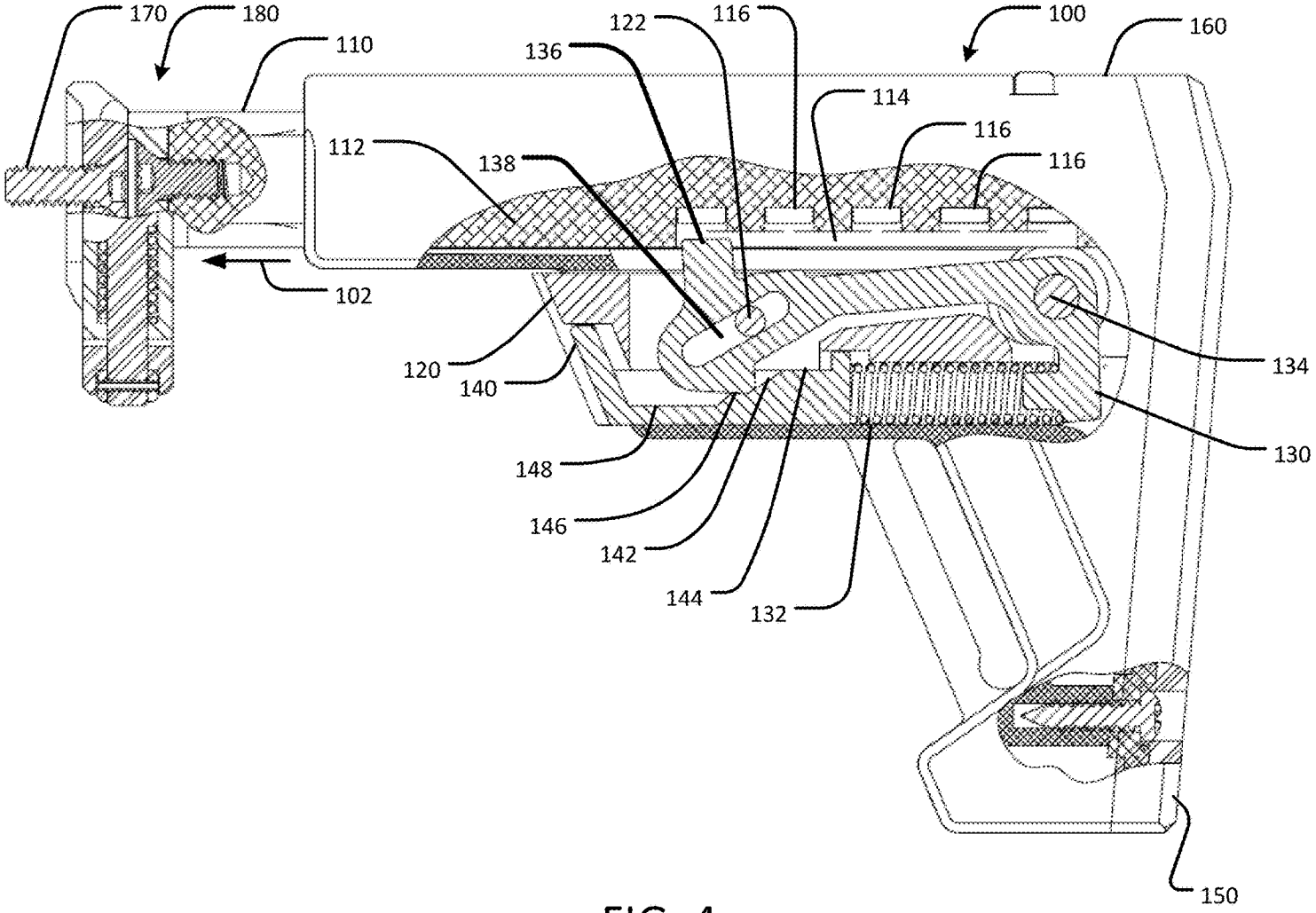
FIG. 4 is another side cutaway view of the example adjustable stock assembly of FIG. 1, shown in a retracted and unlatched configuration, in accordance with an embodiment of the present disclosure.
Figure 5:
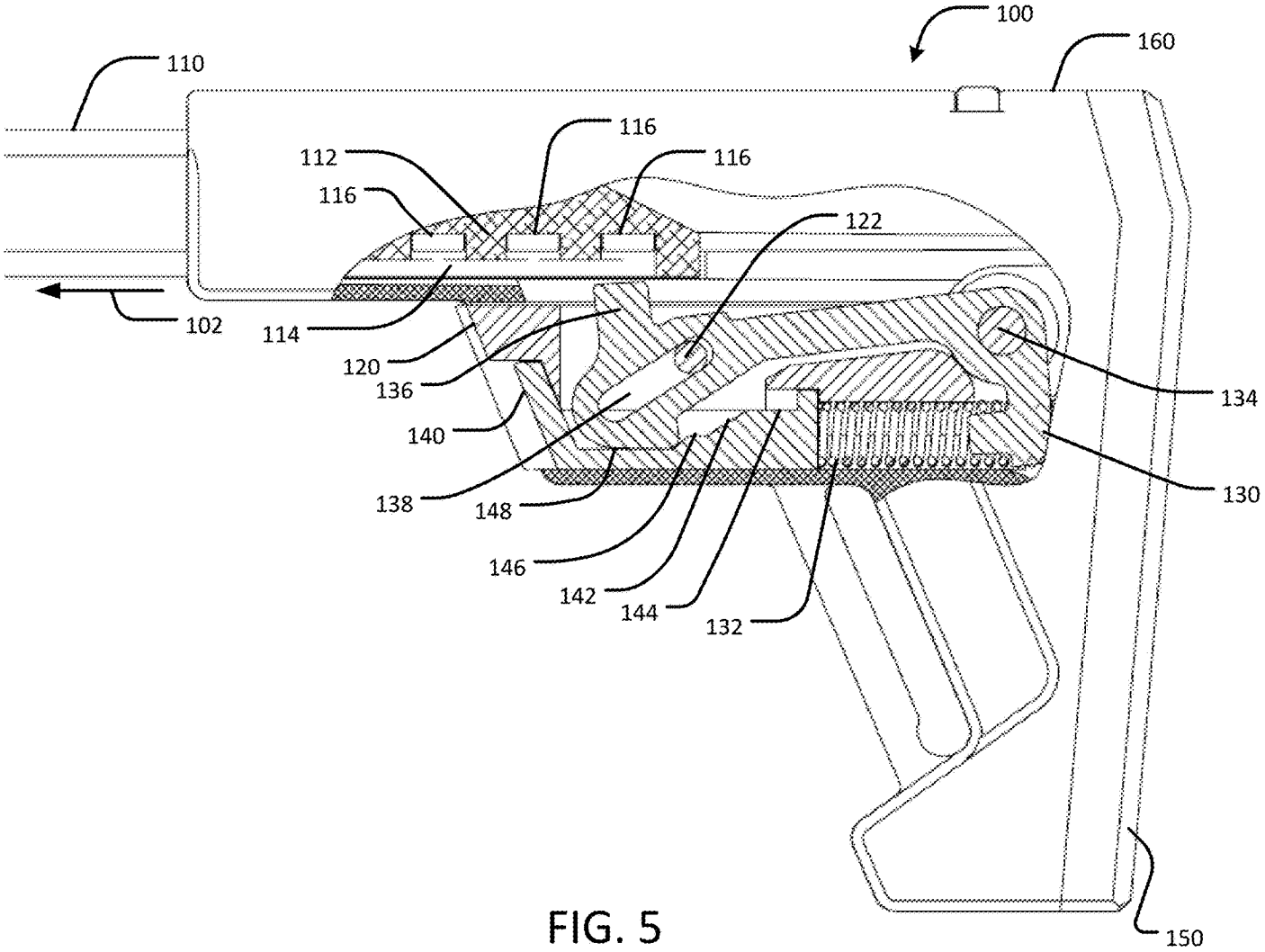
FIG. 5 is another side cutaway view of the example adjustable stock assembly of FIG. 1, shown in a retracted and disassembly configuration, in accordance with an embodiment of the present disclosure.

FIG. 1 is a side cutaway view of an example adjustable stock assembly 100, shown in an extended and latched configuration, in accordance with an embodiment. FIG. 2 is another side cutaway view of the example adjustable stock assembly 100 of FIG. 1, shown in a retracted and latched configuration. FIG. 3 is another side cutaway view of the example adjustable stock assembly 100 of FIG. 1, shown in a retracted and latched configuration with a key partially depressed. FIG. 4 is another side cutaway view of the example stock assembly 100 of FIG. 1, shown in a retracted and unlatched configuration with the key and a release partially depressed. FIG. 5 is another side cutaway view of the example adjustable stock assembly 100 of FIG. 1, shown in a retracted and disassembly configuration with the key and release fully depressed.

The adjustable stock assembly 100 includes a stock rail 110, a release 120, a latch 130, a latch spring 132, a key 140, a recoil pad 150, a housing 160, and a connector 170. One end of the adjustable stock assembly 100 can be attached to a receiver (not shown) via the connector 170. The recoil pad 150 is attached to the opposite end of the adjustable stock assembly 100 and can be used as a shoulder rest. In some embodiments, the adjustable stock assembly 100 includes a folding hinge assembly 180 coupled to one end of the stock rail 110.

The stock rail 110 includes a stem portion 112 with a slot 114, and one or more recesses 116 adjacent to the slot 114. As shown, the stock rail 110 is slideably positioned within a housing 160. The stem portion 112 of the stock rail 110 is configured to allow the housing 160 to retract into and extend. The latch 130 rotates about a latch pivot 134 between a latched position, such as shown in FIGS. 1, 2 and 3, and an unlatched position, such as shown in FIG. 4. The latch spring 132 is configured and arranged to urge the latch 130 toward the latched position by moving the key 140 and release 120 to an extended position. For example, the latch spring 132 may be in compression against the latch 130. With no external force applied to depress the key 140 and release 120, the latch spring 132 moves the key 140 and release 120 forward to an extended position as shown in FIGS. 1 and 2. As the release 120 moves forward, the cam pin 122 disposed on the release 120 moves in the cam slot 138 causing the latch 130 to rotate towards the latched position. The key 140 while in the extended position also maintains the latch 130 in the locked/latched position by positioning upper surface 142 of the key 140 in contact with the latch 130 at cut 144. The latch 130 includes an engagement member 136 configured to engage at least one of the recesses 116 of the stock rail 110 when the latch 130 is rotated into or towards the latched position (e.g., upwards) to secure the stock rail 110 in a desired configuration with respect to the housing 160, such as shown in FIGS. 1 and 2. In the unlatched position, the engagement member 136 is further configured to be positioned within the slot 114 to prevent removal of the housing 160 from the stock rail 110, such as shown in FIG. 4. When the latch 130 is partially rotated out of or away from the latched position (e.g., downwards toward the unlatched position), the engagement member 136 moves clear of the recesses 116, allowing the housing 160 to extend and retract, such as shown in FIG. 4. In this position, the user may adjust the length of the adjustable stock assembly 100 using one hand. For example, the user may orientate the adjustable stock assembly 100 with an attached receiver towards the ground and depress key 140. The combined weight of the stock rail 110 and the receiver can cause the stock rail 110 to move away from the housing 160. The user may select a desired position of the stock rail 110 by releasing key 140. The reverse process can be practiced by pointing the firearm in the air and depressing key 140 to retract the stock rail 110 into the housing 160. Referring back to FIG. 4, in such a partially rotated configuration (e.g., in the unlatched position), the stock rail 110 is prevented from being fully withdrawn from the housing 160 by the latch 130, since the latch 130 is engaged within the slot 114.

The release 120 is configured to move substantially parallel to the longitudinal axis 102 (e.g., forward and rearward). The key 140 is movable with respect to the release 120. The release 120 cannot move unless the key 140 is at least partially depressed. The release 120 may not operate independently from key 140. As a result, this configuration prevents a user from inadvertently unlatching the adjustable stock assembly 100, because the user performs the deliberate action of depressing the key 140 before a change of position for the housing 160 can be accomplished. With the key 140 depressed, the latch 130 is unlocked and can be rotated to the unlatched or disassembly positions by the movement of release 120. The release 120 is coupled to a latch via a cam pin 122. A cam slot 138 is formed in the latch 130 and can be oval or stadium shaped as shown. The long axis of the cam slot 138 is non-parallel (e.g., diagonal) to the longitudinal axis 102 of the adjustable stock assembly 100. The latch cam pin 122 is slidably disposed within the cam slot 138 of the latch 130. The latch cam pin 122 slides parallel to the longitudinal axis 102 (e.g., rearward) within the cam slot 138 of the latch 130 when the key 140 is depressed or otherwise manually adjusted allowing the release 120 to move. In turn, movement of the latch cam pin 122 within the cam slot 138 causes the latch 130 to rotate downwards about the latch pivot 134 and causing the engagement member 136 to move out of engagement with the recess 116 and the slot 114. Depressing key 140 and release 120 may also increase the compression force applied to spring 132 and in turn applying an additional force to the latch 130 about latch pivot 134 to assist with rotating the latch 130 downward. The amount of rotation of the latch 130 is a function of the distance that the release 120 travels, and may be limited by the key 140, as further described below. Upon releasing the key 140, the latch spring 132 urges both the key 140 and the release 120 forward to the extended position. As a result of the latch spring 132 causing the release 120 to move forward to the extended position, the cam pin 122 disposed on the release 120 moves horizontally contacting the cam slot 138 in the latch 130 and moving the latch 130 toward the latched position. The latch 130 moves towards the latched position because the torque applied by the cam pin 122 about the latch pivot 134 is greater than the torque applied by the latch spring 132 at the opposing end of the latch 130 about the latch pivot 134. This latch mechanism design creates a mechanical advantage wherein the cam pin 122 may generate a greater torque about latch pivot 134 because the cam pin 122 is located further away from the latch pivot 134 than the latch spring 132. With the latch 130 in the latched position, the key 140 can be fully extended to lock the latch 130 in the latched position.

The key 140 limits rotation of the latch 130, and thereby the release 120 via the cam pin 122, depending on the position of the key 140. The key 140 is configured to move substantially parallel to the longitudinal axis 102 (e.g., forward and rearward). The key 140 has a profiled upper surface 142 with one or more cuts 144, 146, 148 against which a portion of the latch 130 can come into contact as the latch 130 rotates. The upper surface 142 of the key 140 limits the amount of rotation of the latch 130. Each of the cuts 144, 146, 148 is at different depths. The profile of the upper surface 142 is configured such that when the key 140 is in a forward position, such as shown in FIG. 1, the latch 130 is physically restrained from rotating downwards by the first cut 144. Partially depressing the key 140 rearward causes a second cut 146 on the upper surface 142 to become positioned adjacent to the latch 130, such as shown in FIG. 3. The positioning of the key 140 shown in FIG. 4 allows the latch 130 to rotate downwards a distance sufficient to disengage the latch 130 from the recesses 116 of the stock rail 110. The latch 130 is disengaged from stock rail 110 by fully depressing the key 140 causing continued downward movement of the latch 130 resulting in contact with cut 148 of the upper surface 142 as shown in FIG. 5. When the latch 130 contacts cut 148, the latch is fully withdrawn from the slot 114 of stock rail 110 to facilitate disassembly of adjustable stock assembly 100.

Referring to FIG. 5, the stock rail 110 can be removed (disassembled) from the housing 160 by fully depressing the key 140 into the release 120. When the key 140 is fully depressed, the forward face of the key 140 is beneath the surface of the housing 160. As such, fully depressing the key 140 can be accomplished using a fingertip, a cartridge case or other tool. Pressing the key 140 with the tip of the finger or other device is much different than pushing with the pad of the finger, in that it requires determined effort and is not done accidentally. Once the key 140 is fully depressed, the release 120 is unlocked and can be fully depressed, moving the latch 130 clear of the slot 114 towards the disassembly position (such as shown in FIG. 5), which allows the housing 160 to be pulled clear of the stock rail 110.

Figure 6:
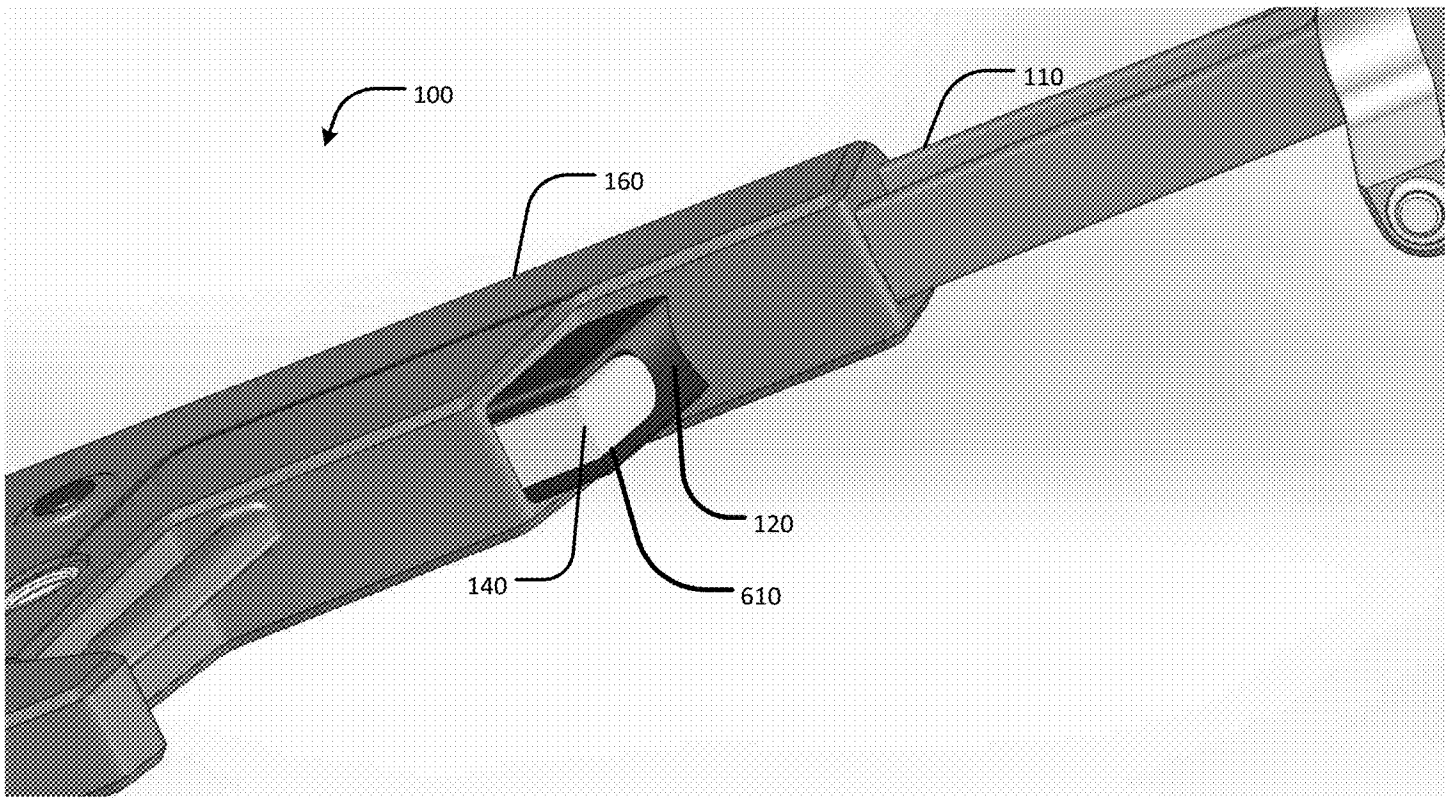
FIG. 6 is a lower front right perspective view of a portion of the example adjustable stock assembly of FIG. 1, in accordance with an embodiment of the present disclosure.

FIG. 6 is a lower front right perspective view of a portion of the example adjustable stock assembly 100 of FIG. 1, in accordance with an embodiment. As shown in FIG. 6, the release 120 includes a recess 610 into which the key 140 is disposed. The recess 610 facilitates moving the key 140 for unlocking the release 120. The stock rail 110 can be unlatched for adjustment of the housing 160 by partially depressing the key 140 into the release 120, such as shown in FIG. 3, then depressing the release 120 as one would pull a trigger, such as shown in FIG. 4. Depressing the release 120 disengages the latch 130, such as shown in FIG. 4. The housing 160 can be moved within its adjustment range while the release 110 is depressed. Letting go of the release 120 engages the latch 130, such as shown in FIGS. 1 and 2.

Figure 7:
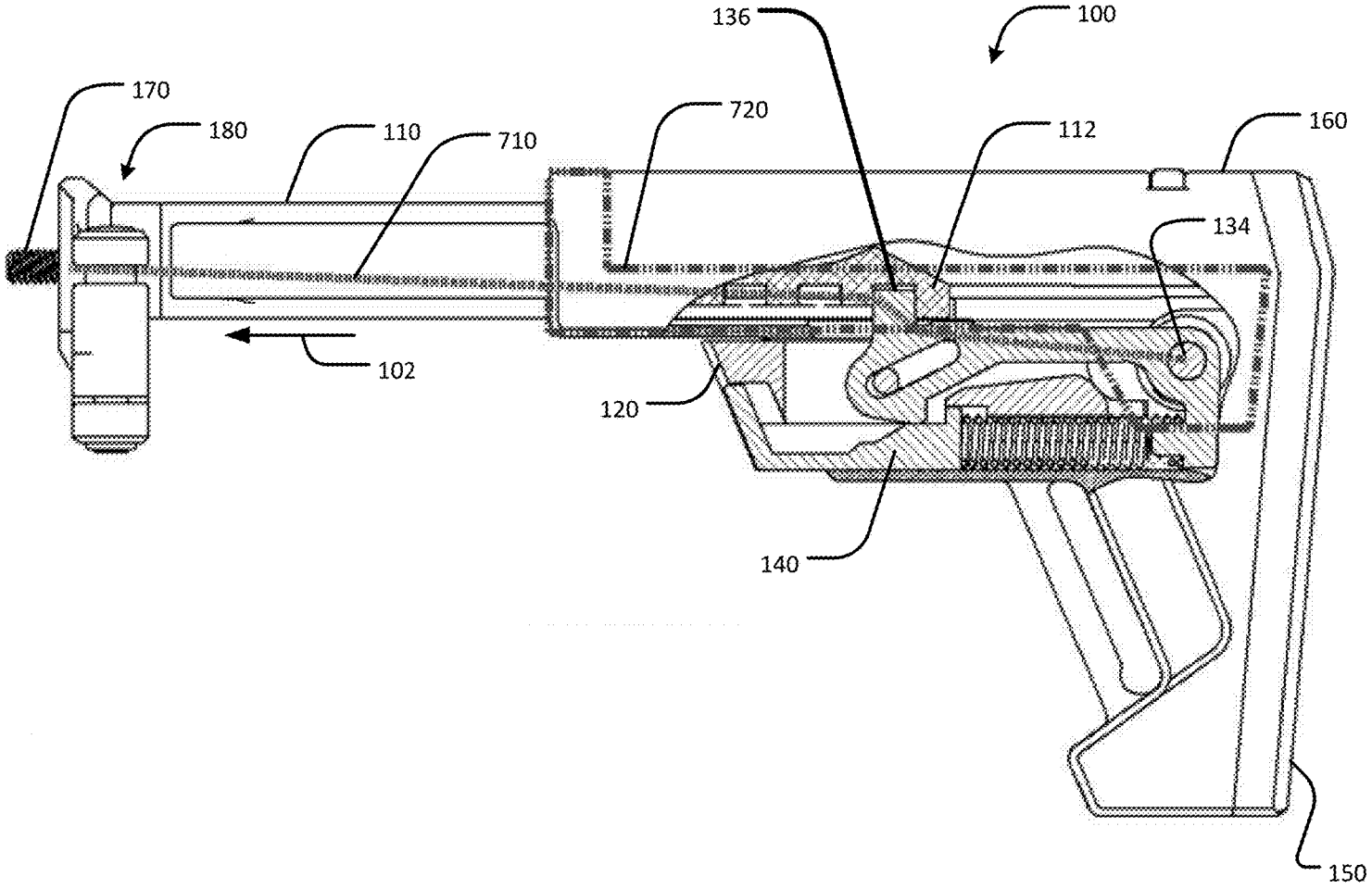
FIG. 7 illustrates an example stress path of the stock assembly of FIG. 1, in accordance with an embodiment of the present disclosure.

FIG. 7 illustrates an example stress path 710 of the stock assembly 100 of FIG. 1, in accordance with an embodiment. Many adjustable firearm stocks fail due to inferior latching mechanisms or stock lockup. Stock lockup occurs over time due to, for example, usage of the stock or when the stock is dropped on a hard surface. In one aspect, the latch and release mechanism disclosed herein provides improved durability of the latching mechanism. Stress from resisting recoil during firing, and from avoiding a change in length adjustment from recoil, is substantially restricted by design to a narrow path from the interface with the receiver (e.g., at or near the connector 170), along the stock rail 110 to the engagement member 136 of the latch 130, further to the latch pivot 134, and further to the housing 160, where the stress is distributed to the operator's shoulder via a large and resilient recoil pad 150. Minimizing the stress path 710 can be achieved, for example, by positioning the latch 130 and latch pivot 134 close to the stock rail 110 and thus reducing the torque applied to the latch 130 during operation. Positioning the latch 130 and latch pivot 134 near the stock rail 110 can also provide a simple and strong adjustable firearm stock design. As a result, some embodiments may include a lightweight stock housing 160 with limited use of thick walls generally in the region indicated at 720. Because of the resilient nature of the recoil pad 150 and the operator's shoulder against which it bears, stress can be effectively transferred between the immediate area of the latch pivot 134 and the recoil pad 150 via thinner walls. The positioning of the latch 130 and latch pivot 134 close to and below the stock rail 110 also creates an "over-center toggle lock" design. As a result, the applied torque from recoil forces during firing or impact forces due to dropping the firearm on a hard surface will be minimal and will not cause latch 136 to be withdrawn from recess 116 inadvertently. The over-center toggle lock configuration of the latch 130 may also ensure that during automatic rifle firing the engagement between the latch 130 and the stem 112 is maintained and thus the latch 130 remains in the latched position. In designs that include a pivot point that is distanced from the stress path of the firearm, a torque will be applied to any latch mechanism when the firearm is dropped or fired. Increasing the distance between the pivot point and the stress path will result in greater torque applied to the latch mechanism during firing or impact with a hard surface. As a result of this increased torque, the internal components of the latch mechanism may need to be larger and more robust to transfer the applied force through the stock assembly. Conversely, reducing the distance between the pivot point and the stress path can reduce the torque applied to the latch mechanism during firing or impact. As a result, smaller latch mechanism components may be used to manufacture a more compact stock assembly. In some embodiments, the vertical distance from the bottom surface of the stem 112 to the center of the latch pivot 134 may be less than one inch, less than 0.5 inches or less than ⅜ inches. In a particular embodiment, this distance is about 5/16 inches.

Figure 8:
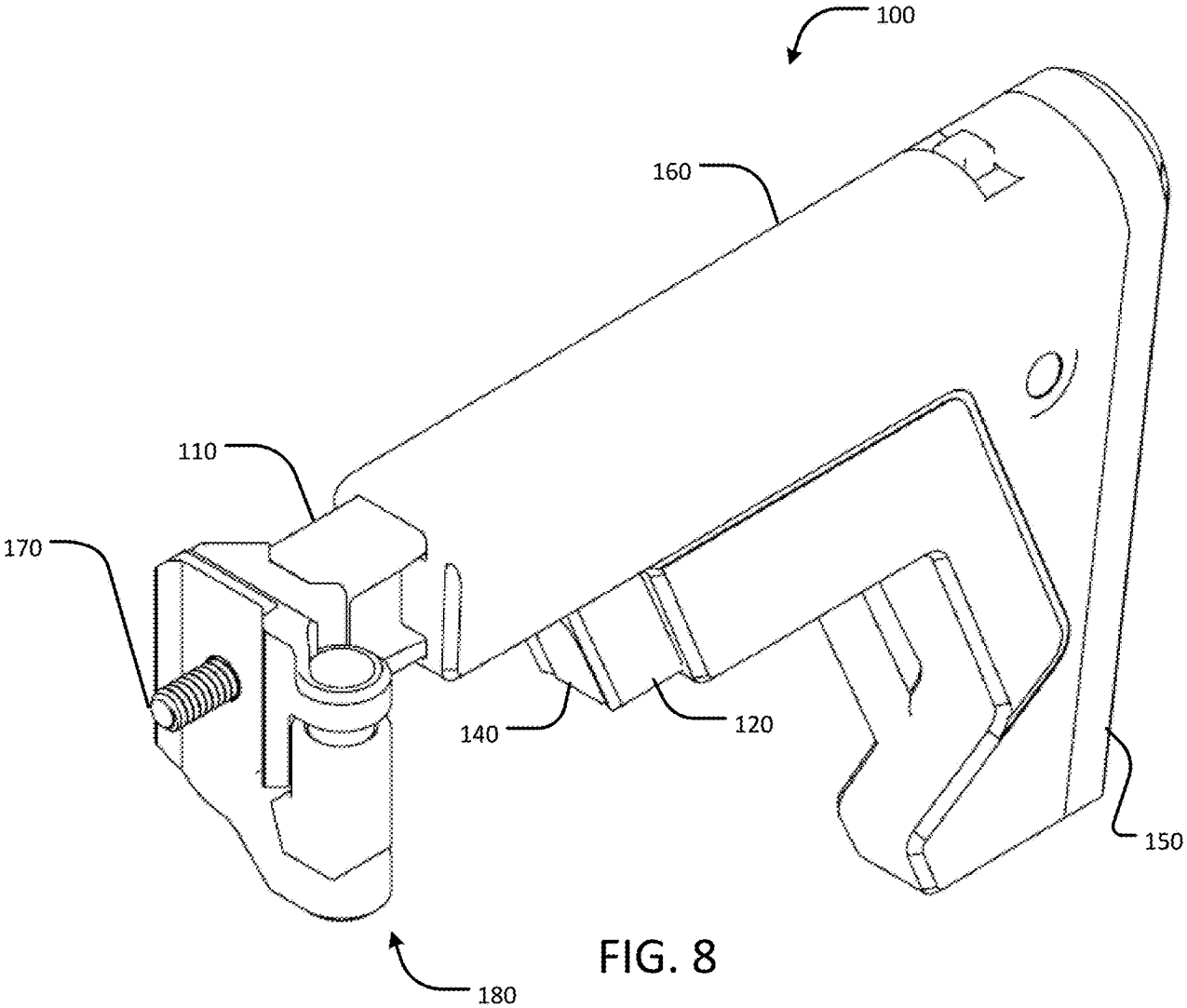
FIG. 8 is an upper front left perspective view of an example adjustable stock assembly, in accordance with an embodiment of the present disclosure.

As will be appreciated in light of this disclosure, the adjustable stock assembly 100 may include additional, fewer, and/or different elements or components from those here described, and the present disclosure is not intended to be limited to any particular configurations or arrangements of elements such as those variously described herein, but can be used with numerous configurations in numerous applications. Further, while in some embodiments, the adjustable stock assembly 100 can be configured as shown and described with respect to the various figures, the claimed invention is not so limited. For example, FIG. 8 shows an example adjustable stock assembly in accordance with an embodiment. In FIG. 8, the key 140 and the release 120 are shown in a non-depressed configuration. Other suitable geometries, arrangements and configurations for various elements and components of the adjustable stock assembly 100 will depend on a given application and will be apparent in light of this disclosure.

In many embodiments the adjustable firearm stock may have a low number of parts and may be easy and inexpensive to assemble and manufacture. For example, the subassembly consisting of: the latch, release including cam pin, key and latch spring may be inserted through the back of the housing as a single assembly. In some embodiments, this subassembly may be secured to the housing upon installation of the latch pivot. Thus, many of the internal stock components can be assembled outside the housing, thereby improving manufacturing efficiency. Further efficiencies may be achieved by manufacturing the housing using a single core pull mold.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Subsequent applications claiming priority to this application may claim the disclosed subject matter in a different manner and generally may include any set of one or more limitations as variously disclosed or otherwise demonstrated herein.

What is claimed is:

1. An adjustable stock assembly for a firearm comprising:
- a housing;
- a stock rail having a slot and a plurality of recesses adjacent to the slot and positioned in the housing, wherein the housing is extendable and retractable with respect to the stock rail;
- a latch being rotatable relative to the stock rail between a latched position, an unlatched position and a disassembly position, the latch having an engagement member configured to engage one of the recesses of the stock rail while the latch is in the latched position and to engage the slot while the latch is in the unlatched position;
- a release operatively coupled to the latch; and
- a key movable with respect to the release, the key being configured and arranged to limit rotational movement of the latch.

2. The adjustable stock assembly of claim 1, wherein the key has a profiled upper surface having a plurality of cuts, the key limiting rotation of the latch when the latch contacts one of the cuts.

3. The adjustable stock assembly of claim 2, wherein the key is configured to be manually depressed, whereby manual depression of the key positions one of the cuts adjacent to the latch, thereby permitting rotation of the latch.

4. The adjustable stock assembly of claim 1, wherein the release is movable parallel to a longitudinal axis of the adjustable stock assembly, and wherein the adjustable stock assembly further comprises a cam slot formed in the latch, the cam slot being non-parallel to the longitudinal axis.

5. The adjustable stock assembly of claim 4, further comprising a latch cam pin coupled to the release and disposed within the cam slot of the latch.

6. The adjustable stock assembly of claim 5, wherein the latch cam pin is configured to move within the cam slot in response to movement of the release, wherein manual depression of the key allows the release to move causing the latch cam pin to move within the cam slot, in turn causing the latch to rotate away from the stock rail, thereby disengaging the engagement member from the recess.

7. The adjustable stock assembly of claim 1, further comprising a latch spring configured to urge the latch toward the latched position and urge the key to an extended position; and
- wherein when the key and release are pressed, force is transferred through the latch spring to urge the latch to the unlatched position.

8. The adjustable stock assembly of claim 1, further comprising a connector coupled to the stock rail for attaching a receiver to the adjustable stock assembly.

9. The adjustable stock assembly of claim 1, wherein the latch is configured as an over-center toggle lock.

10. An adjustable stock assembly comprising:
- a housing;
- a stock rail having a slot and a plurality of recesses adjacent to the slot, the housing can be extendable and retractable with respect to the stock rail;
- a release movable parallel to a longitudinal axis of the adjustable stock assembly;
- a latch pivot;
- a latch being rotatable relative to the stock rail about the latch pivot between a latched position, an unlatched position and a disassembly position, the latch having:
  - an engagement member configured to engage one of the recesses of the stock rail while the latch is in the latched position and to engage the slot while the latch is in the unlatched position; and
  - a cam slot formed in the latch, the cam slot being non-parallel to the longitudinal axis;
- a latch spring configured to urge the latch toward the latched position;
- a latch cam pin coupled to the release and disposed within the cam slot of the latch; and
- a key movable with respect to the release, the key being configured and arranged to limit rotational movement of the latch.

11. The adjustable stock assembly of claim 10, wherein the key has a profiled upper surface having a plurality of cuts, the key limiting rotation of the latch when the latch contacts one of the cuts.

12. The adjustable stock assembly of claim 11, wherein the profiled upper surface of the key has three cuts, and wherein:

in a first configuration, the latch is in contact with a first cut preventing the latch from rotating towards the unlatched position;

in a second configuration, the latch is in contact with a second cut that is deeper than the first cut permitting the latch to rotate towards the unlatched position, thereby causing the engagement member of the latch to be disengaged from all of the recesses of the stock rail; and in a third configuration, the latch is in contact with a third cut that is deeper than the second cut permitting the latch to rotate towards the disassembly position, thereby causing the engagement member of the latch to clear the slot of the stock rail and permitting disassembly of the stock rail from the housing.

13. The adjustable stock assembly of claim 10, wherein the latch cam pin is configured to move within the cam slot in response to movement of the release, whereby manual depression of the release causes the latch cam pin to move rearward within the cam slot, in turn causing the latch to rotate away from the stock rail, thereby disengaging the engagement member from the recess.

14. The adjustable stock assembly of claim 10, wherein the key is configured to be manually depressed, whereby manual depression of the key positions one of the cuts adjacent to the latch, thereby permitting rotation of the latch.

15. The adjustable stock assembly of claim 10, wherein the latch is configured as an over-center toggle lock.

16. The adjustable stock assembly of claim 10, further comprising a foldable hinge coupled to one end of the stock rail.

17. An adjustable stock assembly comprising:

a housing;

a stock rail having a slot and a plurality of recesses adjacent to the slot;

a latch pivot;

a latch being positioned beneath the stock rail within the housing and rotatable relative to the stock rail about the latch pivot between a latched position, an unlatched position and a disassembly position, the latch having an engagement member configured to engage one of the recesses of the stock rail while the latch is in the latched position and to engage the slot while the latch is in the unlatched position; and a release disposed in the housing and having an opening; and a key disposed within the opening of the release, wherein depressing the key allows the release to move and causing the latch to be displaced from the plurality of recesses in the stock rail causing the housing to be extendable and retractable with respect to the stock rail.

18. The adjustable stock assembly of claim 17, further comprising a cam slot formed in the latch.

19. The adjustable stock assembly of claim 18, further comprising a latch cam pin disposed within the cam slot of the latch.

20. The adjustable stock assembly of claim 17, further comprising a connector coupled to the stock rail for attaching a receiver to the adjustable stock assembly.

* * * * *